United States Patent [19]

Ueda et al.

[11] 4,049,540

[45] Sept. 20, 1977

[54] PROCESS FOR THE THERMAL CRACKING OF HEAVY OILS WITH A FLUIDIZED PARTICULATE HEAT CARRIER

[75] Inventors: Tetsuo Ueda; Shigeo Yoshioka; Yoshihiko Shohji; Tsunemitsu Tanaka, all of Yokohama; Yukio Kikuchi; Nobuo Fujita, both of Tokyo; Norio Kaneko; Toshiharu Tanemoto, both of Yokohama, all of Japan

[73] Assignees: Chiyoda Chemical Engineering & Construction Co. Ltd.; Mitsubishi Petrochemical Company Limited, Tokyo, both of Japan

[21] Appl. No.: 663,818

[22] Filed: Mar. 4, 1976

[30] Foreign Application Priority Data

| | | |
|---|---|---|
| Mar. 8, 1975 | Japan | 50-27599 |
| Mar. 11, 1975 | Japan | 50-28684 |

[51] Int. Cl.[2] ..... C10G 9/32

[52] U.S. Cl. ..... 208/127; 208/48 Q; 208/162

[58] Field of Search ..... 208/127, 162, 48 Q

[56] References Cited

U.S. PATENT DOCUMENTS

| | | | |
|---|---|---|---|
| 2,879,224 | 3/1959 | Lawson | 208/162 |
| 2,946,741 | 7/1960 | Miller | 208/127 |
| 3,855,070 | 12/1974 | Squires | 208/127 |

*Primary Examiner*—Herbert Levine
*Attorney, Agent, or Firm*—Armstrong, Nikaido & Marmelstein

[57] ABSTRACT

A process for the thermal cracking of heavy oils with a fluidized particulate heat carrier is carried out while recovering particles of the heat carrier accompanied by a stream of the reaction product by means of a cyclone and a gravitational separator, returning the particles of the heat carrier recovered by the cyclone directly to the reactor and returning the particles of the heat carrier recovered by the gravitational separator to the reactor in the form of suspension in a cracked oil.

6 Claims, 2 Drawing Figures

PROCESS FOR THE THERMAL CRACKING OF HEAVY OILS WITH A FLUIDIZED PARTICULATE HEAT CARRIER

FIELD OF THE INVENTION

The present invention relates to a process for the thermal cracking of heavy hydrocarbon oils, such as crude oil, topped crude oil, fuel oil, reduced pressure residual oil, tar sand oil, pitch, asphaltene and the like (hereinafter referred to as "heavy oils"). More particularly, the invention relates to a process for the thermal cracking of heavy oils wherein a heavy oil is fed to a reactor, in which a fluidized bed of a particulate heat carrier is maintained, and thermally cracked at a temperature of 700° to 850° C in the presence of steam to produce olefins such as ethylene. Especially, it relates to such a process wherein a cyclone dust collector and a gravitational separator are jointly used to recover the particles of the heat carrier which have escaped from the top of the reactor.

BACKGROUND OF THE INVENTION

Processes for the production of olefins wherein a crude oil, various residual oils and other heavy oils are thermally cracked by means of a fluidized bed of a particulate heat carrier, have heretofore been known, for example, from Japanese Patent Publication No. 36,289/1970.

The known apparatus for carrying out such processes are generally provided with a cyclone dust collector in order to reduce the loss of the particulate heat carrier. Most of the particles of the heat carrier, which have been accompanied by a stream of the reaction products and escaped from the reactor may be collected by the cyclone and returned to the fluidized bed.

In the thermal cracking of heavy oils, carbonaceous materials are normally by-produced to a great extent. A portion of such carbonaceous materials will deposit onto the particles of the heat carrier in the reactor, while the remaining portion will leave the fluidized bed. In the thermal cracking of heavy oils, the amount of the carbonaceous materials leaving the fluidized bed is of course larger than that in the thermal cracking of lighter oils, and it is unavoidable that such carbonaceous materials are deposited on the walls of various parts of the apparatus, located along the path between the reactor and a device for quenching the thermally cracked product. Such deposition and accumulation of carbonaceous materials are especially remarkable when the process is carried out at high temperatures as is the case with the process of the invention. For the purpose of producing olefins a temperature as high as 700° to 850° C must be kept in the reactor.

Once such deposition of carbonaceous materials (generally referred to as "coking") has occurred on inside walls of the cyclone, protrusions and depressions are formed on inner surfaces of the walls which disturb the flow of gases in the cyclone and prevent solid particles to be collected by the cyclone from smoothly moving along the walls of the cyclone. Thus, the dust collecting ability of the cyclone is lowered to a great extent. On the other hand, in the thermal cracking of heavy oils for producing olefins, high temperatures must be kept in the reactor and at the same time the process must be carried out with the residence time of the cracked products in the reactor being as short as possible. Otherwise the products are excessively cracked to those of low value.

To realize the desired short residence time, the reactor must be operated with the highest possible linear velocity of gas in the fluidized bed and with the smallest possible space above the fluidized bed. As a result, on one hand, the fluidized state of the particles in the bed is so vigorous and non-uniform, that short period pressure variations in the reactor become considerably large, and, on the other hand, the interface between the fluidized bed and the space above the bed approaches the exit of the reactor so that the buffering function of the space is reduced. Consequently, the behavior of particles and the disturbance of gas in the fluidized bed directly affect the cyclone in that variations in the pressure difference between the bottom of the cyclone and the lower end of a duct for returning collected particles to the reactor become large, an the amount of gas flowing up through the duct to the cyclone increases. These factors, in addition to the above-discussed coking, further lower the dust collecting ability of the cyclone.

As discussed above, in a process for producing olefins by thermally cracking heavy oils with a fluidized bed carrier. owing to the required high temperature and short residence time, the dust collecting ability of the cyclone is inevitably lowered with time. Accordingly, when compared to other processes using a similar fluidized heat carrier under different conditions, the amount of particles of the heat carrier escaping the reactor, which is uncollected by the cyclone and passes to the steps of processing the reaction products, is considerably large, resulting in frequent troubles in operation.

As a particulate heat carrier, a particulate coke, sand, and finely divided ceramics may be used. The particles of the heat carrier forming the fluidized bed may be classified into two classes, one comprising coarse particles and which may readily be collected by a cyclone, and the other comprising fine particles which are inherently difficult to collect by a cyclone. The particles of the heat carrier, which are passed to the steps of the processing of the reaction products, are mainly comprised of the above-mentioned fine particles and a portion of the above-mentioned coarse particles having relatively small diameters. Accordingly, the particles of the heat carrier remaining in the reactor are of a relatively large size. Further, the deposition of cracked coke onto the particles make them larger. As a result, the fluidized state in the bed becomes intolerably non-uniform, and pressure variations in the reactor become large. These changes with time make it difficult to smoothly operate the apparatus. Furthermore, when the reactor comprises heating and reaction columns through which the fluidized heat carrier is recirculated, a smooth recirculation of particles between these columns is also prevented if the particles in the fluidized bed become excessively large.

In the addition to the above-discussed problems, the following inconvenience is also involved with respect to the material balance of the particulate heat carrier in the fluidized bed. In a reactor for thermally cracking heavy oils with the fluidized particulate heat carrier, while a coke is produced in the fluidized bed by the thermal cracking of heavy oils, the particles of the heat carrier are pulverized by the impingement and friction of the particles with each other and with the walls of the reactor, and the resultant fine particles may be withdrawn from the reactor accompanied by a stream of the reaction product. Particularly, when a particulate coke is used as a heat carrier, loss of heat carrier occurs partly due to the gasification of the coke by the reaction with steam in the reactor and partly due to a lowering in the dust collecting ability of the cyclone located at the exit of the reactor. As already discussed, the dust collecting ability of the cyclone is progressively lowered with time. As the loss of coarse particles of the coke due to a lowering in the dust collecting ability of the cyclone increases, the total loss of coke eventually exceeds the amount of coke produced even in the case where a heavy oil, which is likely to form a significant amount of coke, is used as a feed oil. Thus, it becomes necessary to supply an additional amount of particulate coke in order to maintain the required volume of the fluidized bed.

In order to cope with these circumstances, a quantity of the particulate heat carrier must frequently be withdrawn from the fluidized bed, pulverized, sieved and then returned to the bed to prevent the size of the particles in the bed from becoming excessively large; a fresh particulate heat carrier in an amount to compensate for the loss thereof must be added to the fluidized bed and; in order to prevent fine and coarse particles of the heat carrier which have passed to the steps of processing of the reaction product from depositing in parts along the path of the cracked oil, thus causing troubles in operation, these particles of the heat carrier must be separated from the cracked oil and further processed. However, it is not only extremely troublesome but also economically quite disadvantageous to frequently carry out the withdrawal, pulverization and returning of the particles and the supplying of fresh particles.

As already stated, the known apparatus are generally provided with a cyclone at the exit of the reactor in order to recover the solid particles accompanied by a stream of the reaction product. The primary object of providing the cyclone resides in the prevention of loss of particles as well as in the prevention of the contamination of reaction product with particles of the heat carrier suspended therein. Accordingly, in the prior art, fine particles of the heat carrier, which have been uncollected by the cyclone, are separated from the reaction product as follows. The reaction product containing such uncollected fine particles of the heat carrier is quenched to provide a cracked oil containing the particles of the heat carrier suspended therein; the oil is fractionated in a vacuum distillation column and; the resultant relatively high boiling oil containing the particles of the heat carrier is processed by means of a centrifuge or filter to remove the solid particles. However, some of the particles accompanied by the reaction product are so fine that it is difficult to completely remove them from the oil. Additionally the treatment of separated particles in troublesome since they are wetted with cracked oil.

Accordingly, it is an object of the invention to provide a solution to the above-mentioned various problems normally involued in a process for the thermal cracking of heavy oils with a fluidized particulate heat carrier.

Another object of the invention is to provide a process for the thermal cracking of heavy oil by which an improvement of the material balance of the particulate heat carrier and a desirably small change with time of the particle size distribution of the particulate heat carrier can be achieved and which can be continuously carried out for a prolonged period of time under substantially constant conditions.

A further object of the invention is to provide a process for the thermal cracking of heavy oils in which coking onto inner walls of the cyclone and its duct for returning collected particles to the reactor is eliminated or reduced and which may be carried out while maintaining a high level of the dust collecting ability of the cyclone.

SUMMARY OF THE INVENTION

We have found that if a process for the thermal cracking of heavy oils with a fluidized particulate heat carrier is carried out while recovering particles of the heat carrier accompanied by a stream of the reaction product by means of a cyclone and a gravitational separator, returning the particles of the heat carrier recovered by the cyclone directly to the reactor and returning the particles of the heat carrier recovered by the gravitational separator to the reactor in the form of a suspension in a cracked oil, an improvement in the material balance of the particulate heat carrier and a desirably small change with time of the particle size distribution of the particulate heat carrier can be achieved so that the process may be continuously carried out for a prolonged period of time under substantially constant conditions.

Thus, according to the invention there is provided a process for the thermal cracking of heavy oils with a fluidized bed of a particulate heat carrier comprising forming a fluidized bed of a particulate heat carrier by a heavy oil and steam in a reactor and thermally cracking said heavy oil at a temperature of 700° to 850° C, characterized in that most of the particles of the heat carrier accompanied by a stream of the reaction product are recovered by a collector for collecting particles of the heat carrier and returned to said fluidized bed; the rest of the particles of the heat carrier, which are not recovered by said collector and pass to steps of processing of the reaction product, are allowed to gravitationally settle in a cracked heavy oil; said cracked heavy oil is separated into two portions, one containing relatively coarse particles of the heat carrier densely suspended therein and the other containing relatively fine particles of the heat carrier suspended therein; and said portion of the cracked heavy oil, which contains relatively coarse particles of the heat carrier suspended therein, is returned to said fluidized bed.

It has also been found that upon carrying out the process as defined above, if the cyclone is located outside the thermal cracking reactor, and the particles of the heat carrier collected by the cyclone are returned to the reactor at a position which is below the position where the heavy oil is fed to the reactor, coking onto inner walls of the cyclone and its duct for returning collected particles to the reactor is eliminated or greatly reduced so that the process can be carried out for a prolonged period of time without suffering from undesirable lowering of the dust collecting ability of the cyclone.

If desired, the particles of the heat carrier suspended densely in the cracked heavy oil, which are relatively coarse, are washed with a light oil and then returned to said fluidized bed. By doing so, the particles of the heat carrier which are wetted with a cracked heavy oil and are rather sticky, can be converted to particles which are not sticky and are readily handled.

DETAILED DESCRIPTION OF THE INVENTION

The invention will be further described with reference to the attached drawings in which.

Figure 1:
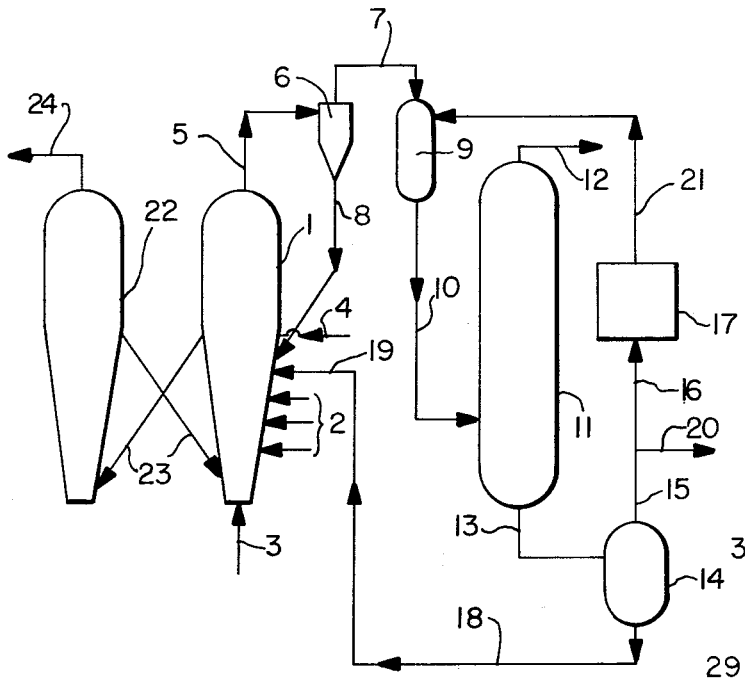
FIG. 1 is a flow chart for illustrating an apparatus for carrying out a preferred embodiment of the process of the invention.

A specific form of the invention will now be described with reference to FIG. 1.

A thermal cracking reactor 1 utilized a fluidized bed of a particulate heat carrier is maintained at a temperature ranging between 700° and 850° C. The particulate heat carrier is fluidized by blowing steam into the reactor through nozzles 2, 3 provided at a lower part of the reactor, and a feed oil to be processed is fed into the fluidized bed through a nozzle 4.

In the reactor the feed oil is thermally cracked to produce a cracked gas and oil as well as carbonaceous materials. Almost all or a major part of the carbonaceous materials deposits on the surfaces of the particles forming the fluidized bed of the heat carrier.

The cracked gas and a vapor of the cracked oil is passed through a conduit 5 to a cyclone 6 where most of the particles of the heat carrier accompanied by the gaseous stream from the reactor are separated from the stream and then returned through a conduit 8 to the reactor 1.

Partly because of the decrease in the gas-solid separating ability of the cyclone 6 due to deposition of the carbonaceous materials formed by the thermal cracking onto the inner surfaces of the cyclone and partly for other reasons including a possible back flow of gas from the conduit 8, part of the relatively coarse particles of the heat carrier which are normally collected by the cyclone, is discharged through a conduit 7 to a quenching device 9 together with the cracked gas, the vapor of the cracked oil and fine particles of the heat carrier incapable of being collected by the cyclone 6. The mixture is quenched in the device 9 to a temperature of 150° to 350° C by spraying an oil and is then passed through a pipe 10 to a distillation column 11 which is operated at normal pressure.

A mixture of the cracked gas and a fraction of the oil of boiling point below 170° or 230° C, is passed from the top of the distillation column 11 to the subsequent processing steps. The remaining fraction of the oil boiling at higher temperatures provides a liquid containing fine and coarse particles of the heat carrier, and is passed through a duct 13 to a gravitational separator 14 by its own weight or by a suitable pressure difference between the column 11 and the separator 14 (without passing through any mechanical device). In the gravitational separator, which is maintained at a relatively high temperature, the difference in specific gravity between the oil and the solid heat carrier is considerably large and the viscosity of the oil is low. Accordingly, if the separator is operated with a low rate of flow or a long residence time, coarse particles of the heat carrier readily settle down and accumulate at the bottom of the separator 14, whereby an oil containing 5 to 40% by weight of coarse particles of the heat carrier suspended therein and an oil containing only fine particles of the heat carrier may be separated. If desired, the distillation column may be constructed so that the bottom portion of said column may serve as a gravitational separator. Coarse particles of the heat carrier suspended in the cracked oil are withdrawn from the gravitational separator at the bottom thereof and recycled through a duct 18 and a nozzle 19 to the reactor 1, where they are re-used as the particles forming the fluidized bed. Accordingly, the loss of coarse particles can be eliminated and the change of particle size distribution in the fluidized bed with time may be slowed. The oil, from which coarse particles of the heat carrier have been separated, is withdrawn from the separator 14 through a pipe 15. A major portion of the oil is to be recycled to the quenching device 9, and is passed through a pipe 16 to a heat exchanger 17, where it is cooled and then returned through a pipe 21 to the quenching device. Since the oil is free from coarse particles of the heat carrier, an oil spraying nozzle in the quenching device, the heat exchanger, flow control value, pump for regulating the flow rate of oil, and flow meter do not suffer from clogging due to deposition of coarse particles. The rest of the oil is passed through a pipe 20 to subsequent processing steps.

The heat required for the thermal cracking of the heavy oil is supplied to the particulate heat carrier maintained in a fluidized state in a heating column 22. The fluidized heat carrier is recirculated through the heating column 22 and reaction column 1 via ducts 23 for transporting particles of the heat carrier. The heating may be effected by burning a suitable fuel, such as carbonaceous materials, fuel oil or fuel gas, in the heating column 22. The flue gas is withdrawn from the heating column through a duct 24.

In the process according to the invention, even in a cse where appreciable amounts of the particles of the heat carrier are not collected by the cyclone located at the exit of the reaction column due to decrease in its efficiency, but pass to steps of processing of the reaction product, it is not necessary to isolate completely the particles of the heat carrier from the by-produced cracked oil. Accordingly, it is possible in the process of the invention to utilize gravitational separation, which is the simplest and most reliable method of separating the coarse particles of the heat carrier. Furthermore, other separating means, such as a centrifuge and filters, are not necessary for carrying out the process of the invention. Thus, the process of the invention is completely free from mechanical troubles involved in such means.

In the gravitational separator, coarse particles of the heat carrier may readily be caused to settle down in the cracked oil, so far as they have a particle size of at least 0.15mm, by continuously introducing the cracked oil containing the particles suspended therein to the gravitational separator comprising a suitable vessel, while controlling the flow rate of liquid in the vessel to be substantially less than the terminal velocity of the particles. The settling down of the particles may be facilitated by lowering the viscosity of the oil or by raising the temperature of the oil. The coarse particles of the heat carrier which have been allowed to settle down in the gravitational separator may be withdrawn from the separater at the bottom thereof as a dense suspension in the cracked oil. By recycling the suspension, all the coarse particles of heat carrier coming from the fluidized bed may be returned to the reactor, ensuring the minimum loss of the particulate heat carrier as well as preventing coarse particles having relatively small diameters from being selectively lost. Accordingly, the change of the average size and size distribution of the particles of the heat carrier with time is extremely slow, and the frequencies of procedures such as withdrawal, pulverization and returning of the particulate heat carrier required for the regulation of particle size may be reduced, whereby the economy and reliability of the apparatus may be substantially enhanced. Thus, it is possible to continuously carry out the process of the invention for a prolonged period of time. Furthermore, since a closed path of the cracked slurry oil comprising coarse particles of the heat carrier may be formed in the process of the invention for the suspension, the process of the invention does not suffer from various problems regarding the successful treatment of such a suspension, which are generally extremely difficult to solve.

As already stated, the gravitational separation of coarse particles of the heat carrier may be carried out in the atmospheric pressure distillation column at the bottom thereof without employing a separating vessel. In this modification, measures (e.g. use of a special pump) to counter the deposition of coarse particles of the heat carrier along the path of the oil need only be considered with respect to the system for recycling the oil containing the coarse particle densely suspended therein to the reactor. No other part of the apparatus requires a measure to counter the deposition of coarse particles of the heat carrier.

In the known apparatus a reaction column and a cyclone are arranged so that the duct for returning a particulate heat carrier collected by the cyclone to the reaction column opens to the reaction column at a position above the level at which the heavy oil feed is fed to the reaction column. In such an arrangement, a pressure balance between the cyclone and the lower end of the particle returning duct as well as that between the lower end of the particle returning duct and the reaction column may be established by the fact that a portion of the cracked gas blows up through the duct. Continued blowing up of the cracked gas inevitably promotes the accumulation of coking materials onto inner surfaces of the cyclone and duct, whereby the particle returning capacity of the duct is reduced by narrowing the path through the duct. The duct collecting efficiency of the cyclone is lowered as well. It has now been found that such disadvantages may be simply and effectively overcome by arranging the reaction column and the cyclone in such a manner that the upper end of the opening of the particle returning duct to the reaction column is positioned at a level which is below the lower end of the opening for supplying the heavy oil feed to the reaction column by a vertical distance which is equal to the diameter of the opening of the duct to the reaction column or greater. The particles of heat carrier which have been returned to the reaction column through the particle returning duct contribute to the regulation of the particle size distribution in the reaction column, are admixed with larger particles in the column and upwardly transferred by the fluidizing steam and utilized in the thermal cracking of the feed oil.

Figure 2:
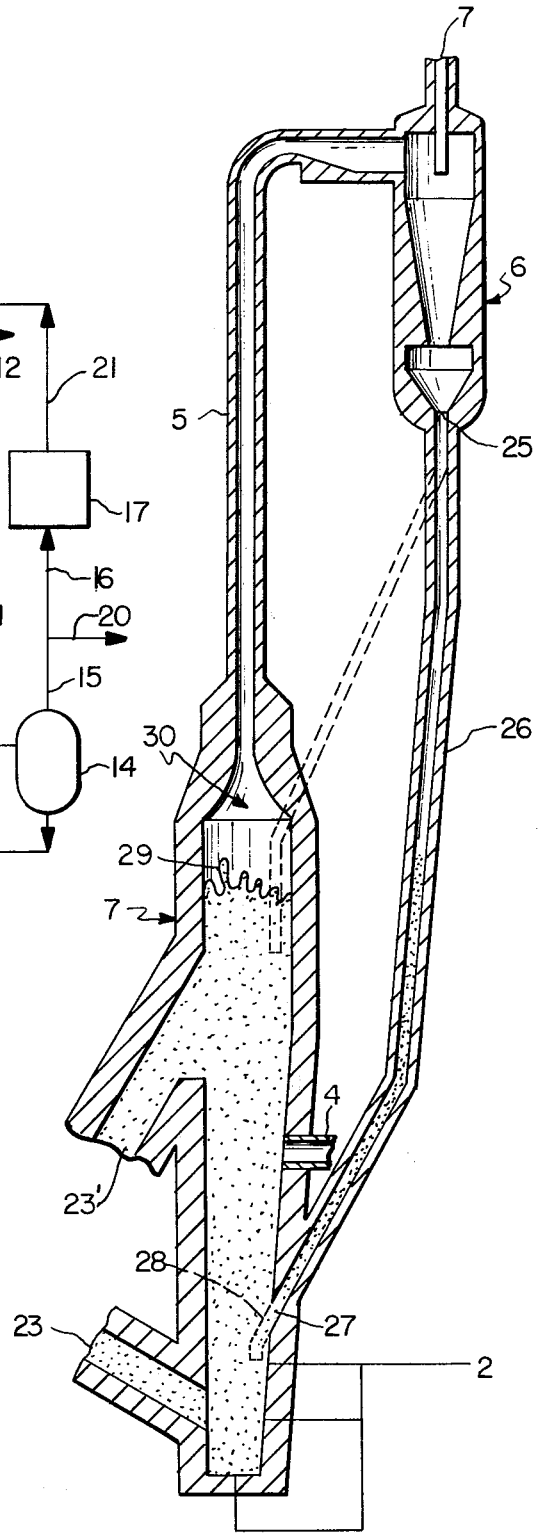
FIG. 2 is an enlarged vertical cross-sectional view showing the reactor column 1 and the cyclone 6 in FIG. 1.

Refering to FIG. 2, in a reaction column 1 a particulate heat carrier is fluidized by a fluidizing gas 2 which is blown into the column through nozzles provided at the bottom and lower part of the side walls of the reaction column. The particulate heat carrier is heated in a heating column (not shown), passed through a duct 23 to the reaction column 1, where it supplies required heat of reaction and maintains the required reaction temperature. A heavy oil feed to be thermally cracked is blown through an opening 4 for supplying it into the fluidized bed maintained in the reaction column. The heavy oil is then thermally cracked, a part being converted to carbonaceous materials which may deposit on the particulate heat carrier while the other part is converted to a cracked gas (most of the cracked products being gaseous at the reacion temperature). It should be noted that the gaseous material, which is present in the upper part of the reaction column above the level at which the heavy oil is fed, comprises the fluidizing gas and the cracked gas, while the gaseous material which is present in the lower part of the reaction column below the level at which the heavy oil is fed, comprises only the fluidizing gas. Cooled particles of the heat carrier, onto which carbonaceous materials have deposited, are passed through a duct 23' to the heating column. When the gaseous material is leaving the surface 29 of the fluidized bed, it is accompanied by a quantity of the particulate heat carrier. This is partly because bubbles are formed in the fluidized bed, ascend through the bed and disappear at the surface of the bed whereupon the disappearing bubbles impart some energy to the particles, and partly because particles of smaller size are formed in the fluidized bed due to possible impingement and friction of larger particles with each other or with the inner walls of the reaction column, such particles of smaller size being likely to accompany a stream of the gaseous material leaving the fluidized bed. A portion of the particles of the heat carrier may not go beyond a space 30 above the fluidized bed and may return to the bed, while the remaining portion may be withdrawn from the reaction column with the gas.

The gas with the particles of heat carrier is then passed through a conduit 5 to a cyclone dust collector 6. The gas from which the particles are substantially separated is then withdrawn through a conduit 7 and passed to subsequent steps where it is processed in a manner as described herein above with reference to FIG. 1. The particles of heat carrier collected by the cyclone 6 are returned from the cyclone at the bottom thereof 25, through a particle returning duct 26 with a lower opening 28 to the fluidized bed in the lower part of the reaction column. The main art of the particle returning duct 26 is located outside the reaction column and communicates with the column at a connection 27 below the level at which the lower end of the oil supply opening 4 is located. The opening 28 may be identical with the connection 27, or may project into the fluidized bed as shown by dotted lines. If desired, the lower end of the duct projecting into the fluidized bed may be so designed that it is upwardly deflected. The particle returning duct 26 must be so arranged that the upper end of its opening 28 is positioned at a level which is below the lower end of the oil supply opening 4 by a vertical distance which is equal to the diameter of the opening 28 or greater. Although the cracked gas is formed in the upper part of the reaction column above the oil supply opening 4 and in general flows upwardly, a minor portion of the cracked gas may move downwardly owing to diffusion phenomenon. By arranging the opening 28 in the above prescribed manner, the possibility of the existence of the cracked gas in the vicinity of the opening 28 may be practically ignore. The lowest level at which the opening 28 may be positioned is not critical. However, the provision of the opening 28 at an excessively low level is not advantageous because a long duct 26 is required.

EXAMPLE 1

Control Run

An apparatus as shown in FIG. 1 was used but the gravitational separator was not operated in this control run. A residual oil having a penetration of 80 to 100, which had been obtained by distallation of a crude oil, produced in the Middle Asia, under a reduced pressure, was supplied to the reactor at a rate of 150kg/hr. The reactor used was generally cylindrical and had an inner diameter of 600mm. The oil was cracked at a temperature of 750° C. Fluidizing steam was used in an amount of 380kg/hr.

The thermal cracking of the oil in the reactor provided 65Nm³/hr of cracked gas, 75kg/hr of a cracked oil and 17kg/hr of coke. The loss of coke due to water gas reaction and that due to the pulverization of the particulate coke were 13kg/hr and 3kg/hr, respectively. The balance of coke at the initial stage was, therefore, 1kg/hr of coke, and, therefore, it was not necessary to externally supply an additional amount of coke. This means the loss of coarse particles of coke from the cyclone was low. At the initial stage of operation, the harmonic average of the diameter of coke particles was 0.5mm and 80% by weight of the total weight of the particulate coke was occupied by particles having a diameter of not more than 0.8mm. These particle size conditions at the initial stage ensured the desirable smooth fluidization, thermal cracking and particle recirculation. However, as the operation was continued the dust collecting ability of the cyclone was gradually lowered and, at the end of 300 hours continued operation the rate of total loss of coke reached 21kg/hr (including a loss of coarse particles of 5kg/hr from the cyclone), exceeding the rate of formation of coke by 4kg/hr, and, thus, it became necessary to externally suply a fresh particulate coke to the system in order to maintain the required volume of the fluidized bed. At that time the average size of coke particles in the fluidized bed was 1.1mm, and particles having a diameter of not more than 0.8mm occupied less than 10% by weight of the total weight of the particulate coke. These particle size conditions badly affected the operation of the apparatus, including, for example, poor performances of particle recirculation and fluidization. Thus, it was necessary to frequently carry out procedures for regulating the average size of particles and the size distribution of particles in the bed.

Run according to the Invention

The process described in the Control Run was repeated except that the gravitation separator was operated to recycle the cracked oil containing coarse particles of coke to the reactor. The gravitational separator was operated under the following conditions.

| | |
|---|---|
| Temperature in the separator | 160° C |
| Linear velocity of liquid in the separator | $5 \times 10^{-3}$m/sec. |
| Terminal velocity of a particulate coke of 0.15mm in diameter | $8 \times 10^{-3}$m/sec. |
| Inner diameter of the separator | 600mm |
| Height of the separator | 1,500mm |

The process was carried out while returning the cracked oil containing coarse particles of coke to the reactor from the beginning of the operation. It was not necessary at all to supply any additional amount of coke to the reactor even after continued operation for a period of 400 hours. At the end of the period the average diameter of coke particles in the fluidized bed was less than 0.6mm, and, therefore, no step was required for regulating the particle size distribution.

At the end of the 400 hrs of continued operation the rate of recycle to the reactor, of the oil containing coarse particles of coke was 60kg/hr comprising 5kg/hr of coarse particles of coke and 4kg/hr of fine particles of coke. For the transport of the suspension a metering pump was used, so designed that it may not go wrong by the existence of coarse particles of coke, and the deposition of coarse particles in the piping was avoided by using a linear velocity of liquid through piping, of 0.1m/sec. or higher. With respect to curved and branched parts of the pipings a special measure was taken.

At the end of 400 hours of continued operation particle size distributions of the particulate coke in the fluidized bed, of the particulate coke collected by the cyclone and of the particulate coke suspended in the cracked oil, were as noted in the table below.

| Diameter of particle in mm | Particle Size Distribution of Particles of coke: In reactor in % by weight | In suspension in % by weight | Collected by cyclone in % by weight |
|---|---|---|---|
| > 1.00 | 16.1 | 2.6 | 10.0 |
| 0.50 – 1.00 | 58.3 | 15.9 | 54.5 |
| 0.15 – 0.50 | 24.6 | 37.1 | 33.4 |
| < 0.15 | 1.0 | 44.4 | 2.1 |

EXAMPLE 2

In this example an apparatus as illusrated in FIG. 2 was used. The inner diameter of the reaction column used was 600mm at the part where the space was formed above the fluidized bed, and the particle returning duct had a inner diameter of 133mm. The particle returning duct was connected with the reaction column at a level below the position where the oil supply opening was provided. The upper end of the opening of the duct was separated from the lower end of the oil supply opening by a vertical distance of 200mm. The process was started using a particulate coke having an average diameter of 0.8mm and steam as a fluidizing gas. The surface of the formed fluidized bed reached a level 1450mm above the center line of the oil supply opening.

A residual oil having a penetration of 80 to 100, which had been obtained by distillation of a crude oil, produced in the Middle Asia, under a reduced pressure, was supplied to the reaction column at a rate of 150kg/hr. For better distribution of the oil in the reaction column it was atomized with steam. The combined amount of the fluidizing steam and the atomizing steam employed was 380kg/hr. Using a reaction pressure of 0.1kg/cm²G at the top of the column and a reaction temperature of 750° C the operation was continued for a period of 410 hours.

In general, the dust collecting ability or efficiency of a given cyclone varies depending upon the particle size of solid dust to be collected. The larger the dust the higher the collecting ability of the cyclone. Accordingly, the dust collecting ability of the cyclone may be estimated by determining its collecting ability, i.e., the amount of uncollected particles as measured for a dust hving a certain relatively large diameter (for example, of a size of at least 0.15mm).

In this example we determined the values of the amount of uncollected particles having a diameter of at least 0.15mm. The data showed that said amount increased with time. The values at the initial stage of the operation and at the end of the operation were 1.0kg/hr and 3.0kg/hr, respectively. From these values, the rate of average increase in the amount of uncollected coarse particles can be calculated as 2.0/410=0.009kg/hr.

After 410 hours operation, the cyclone and particle returning duct were disjointed from the apparatus and examined. Deposition of any carbonaceous material was not observed inside the particle returning duct. In the cyclone, while no deposition of carbonaceous material was observed at the lower portion thereof (from the bottom up to about one third of the height), at the upper part thereof the inner surface had been uniformly coated with accumulated carbonaceous materials of a thickness of about 3mm.

For a comparative purpose, the procedure described above was repeated using an apparatus which was substantially similar to that as employed above except for the location of the particle returning duct. In the apparatus used the particle returning duct was so arranged that it was passed through the space formed above the fluidized bed in the reaction column and inserted into the bed, as shown in FIG. 2 with dotted lines. The opening of the particle returning duct was positioned 500mm below the surface of the fluidized bed. Using the same reaction conditions as in the preceding run the apparatus was operated for a period of 403 hours. The amount of uncollected coarse particles having a diameter of at least 0.15mm, increased with time, with an initial value of 2.0kg/hr and a final value of 8.0kg/hr. From these values, the rate of average increase in the amount of uncollected particles can be calculated as 6.0/403 = 0.0149kg/hr, which is as high as about three times of that obtained in the preceding run. This reveals untolerable lowering of the dust collecting ability of the cyclone due promoted coking having occurred on the inner surfaces of the cyclone and its duest returning duct. In fact, examination of the disjointed cyclone and duct showed that carbonaceous materials had deposited on the outer surface of that portion of the particle returning duct, which had been positioned in the reaction column, forming an accumulated layer of about 10mm in thickness, which carbonaceous materials were likely to be stripped off. Inside the main part of the particle returning duct, carbonaceous materials had deposited in a thickness of about 2 to 5mm. Further inside the cyclone protrusions composed of accumulated carbonaceous materials were observed over the whole surface, extending inwardly a distance of about 50 to 80cm.

What is claimed is:

1. In a process for the thermal cracking of heavy oils with a fluidized bed of a particulate heat carrier wherein (a) a fluidized bed of the particulate heat carrier is formed in a reactor by fluidization with fluids comprising a heavy oil feed and steam; (b) said heavy oil is thermally cracked at a temperature of 700° to 850° C to form a cracked oil product; (c) the cracked oil product together with particulate heat carrier escaping from the reactor is passed through a cyclone to remove a major portion of the particulate heat carrier therefrom; (d) the particulate heat carrier removed from the cracked oil product in the cyclone is returned to the reactor; (e) the cracked oil product containing the remaining portion of said particulate heat carrier is quenched to provide a cracked oil having the remaining particulate heat carrier suspended therein; and (f) said cracked oil is fractionated to provide a relatively high boiling oil containing the particles of the heat carrier suspended therein; the improvement comprising: locating the cyclone for separating the particulate heat carrier from the cracked oil product outside the reactor; returning the portion of the particulate heat carrier removed in the cyclone to the reactor at a position which is below the position where said heavy oil is fed into the reactor; separating said high boiling oil and said remaining portion of particulate heat carrier in a gravitational separator wherein the high boiling oil is separated into two portions, one containing relatively coarse particles of the particulate heat carrier densely suspended therein and the other containing relatively fine particles of the particulate heat carrier suspended therein, and returning said relatively coarse particles of the particulate heat carrier to said fluidized bed.

2. A process in accordance with claim 1, wherein said relatively coarse particles of the particulate heat carrier suspended densely in said high boiling oil are washed with a light oil and then returned to said fluidized bed.

3. A process in accordance with claim 1, wherein said particulate heat carrier is particulate coke.

4. A process in accordance with claim 2, wherein said particulate heat carrier is particulate coke.

5. A proces in accordance with claim 1, wherein said reactor comprises heating and reaction columns, through which the fluidized particulate heat carrier is recirculated.

6. A process in accordance with claim 2, wherein said reactor comprises heating and reaction columns, through which the fluidized particulate heat carrier is recirculated.

* * * * *